US005560557A

United States Patent [19]

Horvath et al.

[11] Patent Number: 5,560,557

[45] Date of Patent: Oct. 1, 1996

[54] YARN BRAKE HAVING AN AXIALLY VIBRATIVE BEARING

[75] Inventors: Attila Horvath, Freudenstadt; Eberhardt Leins, Heiningen; Hermann Schmodde, Horb/Dettlingen, all of Germany

[73] Assignee: Memminger-Iro GmbH, Dornstetten, Germany

[21] Appl. No.: 401,470

[22] Filed: Mar. 9, 1995

[30] Foreign Application Priority Data

Mar. 18, 1994 [DE] Germany ..... 44 09 450.7

[51] Int. Cl.[6] ..... B65H 59/22; B65H 23/16

[52] U.S. Cl. ..... 242/149; 28/194; 66/146; 242/150 M; 242/150 R; 242/419.3; 242/419.4

[58] Field of Search ..... 242/419.3, 419.4, 242/422.2, 150 R, 150 M, 157 R, 47.01, 149; 66/146, 132 R, 132 T; 28/194

[56] References Cited

U.S. PATENT DOCUMENTS 4,313,578 2/1982 Van Wilson et al. ..... 242/149

5,343,983 9/1994 Horvath et al. ..... 188/65.1

FOREIGN PATENT DOCUMENTS 30 29 509 A1 3/1982 Germany .

*Primary Examiner*—William Stryjewski

*Attorney, Agent, or Firm*—Frishauf, Holtz, Goodman, Langer & Chick, P.C.

[57] ABSTRACT

A yarn brake has two brake disks, retained with axial play in a support or bearing device, which are retained against one another via resiliently yielding device, such as permanent magnets. The brake disks are rotatably supported in the support or bearing device. Via an oscillatory motion generator, such as an electromagnet, mechanical or other device, the support or bearing means is set into mechanical oscillation that is essentially axial to the brake disks or in other words parallel to the axis of rotation defined by the rotation of the brake disks. The brake disks are carried along only slightly or not at all by the support or bearing device and the oscillatory motion generator.

23 Claims, 8 Drawing Sheets

YARN BRAKE HAVING AN AXIALLY VIBRATIVE BEARING

FIELD OF THE INVENTION

The present invention relates to yarn brakes in the form of disk or plate shaped brakes. In such brakes, the brake disks or plates forming the brake elements are as a rule rotatable on a guide pin that is retained in stationary fashion on its end. On its other end, this guide pin has a thread onto which an adjustment nut is screwed that forms the counterelement of a compression spring that compresses the two brake disks elastically against one another. The yarn traveling between the brake disks is braked by friction against the brake disks or plates that are tensed against one another, so that the ongoing segment of the yarn is given a somewhat-defined tension.

BACKGROUND

It has been found that even after only a relatively short time in operation, lubricants (paraffins, bobbin oil and so forth) sticking to the surface of the ongoing yarn can lead to deposits on the brake disks. If dirt particles or fluff are embedded in these deposits, the result is a sticky, pasty composition that increasingly invades the area between the brake disks or plates. This ever-increasing accumulation during operation spreads the brake disks or plates locally apart over time, making them less and less capable of performing their braking function on the yarn passing through them. Irregular braking action also results, leading to undesired fluctuations in yarn tension. The mobility of the brake disks or plates is hindered as well, allowing the yarn traveling between them to begin cutting into the braking surfaces of the brake disks or plates. This danger is especially pronounced with synthetic yarns. Yet damage to the braking surfaces worsens the quality of the yarn traveling between them.

These difficulties mean that the yarn brake has to be cleaned, or even replaced completely, at certain time intervals.

In view of these problems, yarn brakes that use brake disks provided with electromagnets acted upon by alternating current have already been contemplated, in German Patent Disclosure DE 30 29 509 A1. These electromagnets are provided in such a way that the brake disk or disks oscillate.

According to DE 30 29 509 A1, difficulties can arise in regulating the alternating current for varying the brake force, yet only relatively narrow control limits for the braking force are available.

In the industry, a yarn brake is known in which two brake plates, each with a central opening, are supported rotatably on a vertically arranged ceramic pin. The ceramic pin is joined rigidly on one end to an electromagnet that is excited by pulsating current. The brake plate remote from the electromagnet is of ferromagnetic steel and is seated on the ceramic pin so as to be axially displaceable. The brake plate is attracted in pulsating fashion by the electromagnet, so that a yarn passed between the brake plates is braked between them.

The brake plate located at the electromagnet rests on a stop. The upper brake plate, since it is acted upon by pulsating forces, executes a slight oscillation, which is disadvantageous with a view to constancy of the braking force exerted on the yarn traveling therethrough.

Another yarn brake is known from U.S. Pat. No. 4,313,578, van Wilson et al. It has two brake plates, seated on a common shaft, one of which is magnetic and the other is nonmagnetic. Coaxially to the shaft carrying the brake plates, there is an electromagnet for the nonmagnetic brake plate; it is capable of attracting the outer, magnetic brake plate toward the nonmagnetic brake plate. A plastic disk of PTFE (teflon) is located between the electromagnet and the nonmagnetic brake plate and is intended to reduce the friction and wear between these parts. The electromagnet is triggered via a control circuit that generates a more or less high current flowing through the electromagnetic, depending on the desired yarn tension. To avoid remanence effects, particularly when the magnetic force generated by the electromagnet decreases, the voltage applied to the electromagnet is pulsed at negative polarity. This is intended to reduce the magnetic force in a desired fashion when the excitation of the electromagnet is decreased.

Action is exerted upon the electromagnet with current pulses solely for demagnetization purposes and to avoid remanence effects. As in the previous example, the magnetic force exerted by the electromagnet also acts only upon the brake plates, so that at least during the reduction in magnetic force by the pulsating voltage, axial oscillation of the brake plates is again brought about, which is deleterious to the constancy of yarn tension.

Finally, U.S. Pat. No. 5,343,983, Horvath et al., discloses a yarn brake in which two brake disks, having a central opening, are retained in a bearing means and are urged resiliently toward one another. In a series of embodiments, the brake disks are rotatably supported with radial play in the bearing means. Causing the bearing means to oscillate radially, oscillation creates a torque that drives the brake disks, by way of the existing play between the brake disks and the bearing means. In another series of embodiments, the radial oscillation generated by an oscillatory motion generating means is carried directly to the brake disks. In both models, both the bearing means and the brake disks oscillate radially, thereby bringing about not only the aforementioned driving effect but also a cleaning effect of the brake disks.

THE INVENTION

The object of the invention is to create a yarn brake that is distinguished by good self-cleaning action and moreover assures uniform yarn braking over long periods of operation.

Briefly, a yarn brake first sets only the bearing arrangement to oscillating. The brake elements, or in this specific case the brake disks or plates, are retained both rotatably and axially displaceably in the bearings means, or bearing arrangement. The axial vibration of the bearing means is therefore imparted to the brake elements only weakly, if at all. The brake elements in fact have a certain mass inertia, whose effect is that by comparison with the bearing means, they oscillate at lesser amplitude. The result is a relative motion between the bearing means and the brake elements. As a result of this relative motion, which is always present in operation of the yarn brake, the static friction that otherwise exists between the brake elements and the bearing means is overcome. However, the force by which the brake elements are to be pressed together is not changed by this oscillation. Since the oscillation is imparted only to the bearing means, and the brake elements are retained axially displaceably in the bearing means, it is possible to employ even relatively high oscillation amplitudes, without notably modulating the force acting between the brake elements. The yarn is thus braked quite uniformly.

Experience has also shown that even with an essentially axial oscillatory motion of the bearing means, rotation of the brake elements can be brought about or reinforced.

Because of the oscillation of the bearing means, the deposit of paraffins, bobbin oil, dirt particles, fluff, and of a sticky, pasty composition forming from them, onto the bearing means, and particularly between the bearing means and the braking arrangements, is reliably averted. Moreover, the brake elements are cleaned not only at the points where they touch the bearing means but also on the surfaces between which the yarn travels. The free rotatability of the brake elements contributes particularly to this, and the rotary motion is reinforced by the oscillation of the bearing means. Thus not only contamination of the brake elements but also sawing in of the yarn into the brake elements, which is otherwise highly disadvantageous, are averted.

The aforementioned advantages are attained especially if the brake elements are decoupled from the bearing means in an axial direction, with respect to force transfer. This is the case if there are no force-transmitting elements, such as springs or the like, present that act between the brake elements and the bearing means. In this case, the brake elements are seated with considerable axial play in the bearing means. The cleaning action between the bearing means and the brake elements is brought about without requiring notable oscillation on the part of the brake elements. This is true particularly if the mass inertia of the brake elements and the frequency of oscillation of the bearing means are dimensioned with reference to one another such that the brake elements essentially do not oscillate, or oscillate at least at a markedly lesser amplitude than the bearing means.

The invention will become more apparent from the ensuing detailed description, taken in conjunction with the drawings.

DETAILED DESCRIPTION

Figure 1:
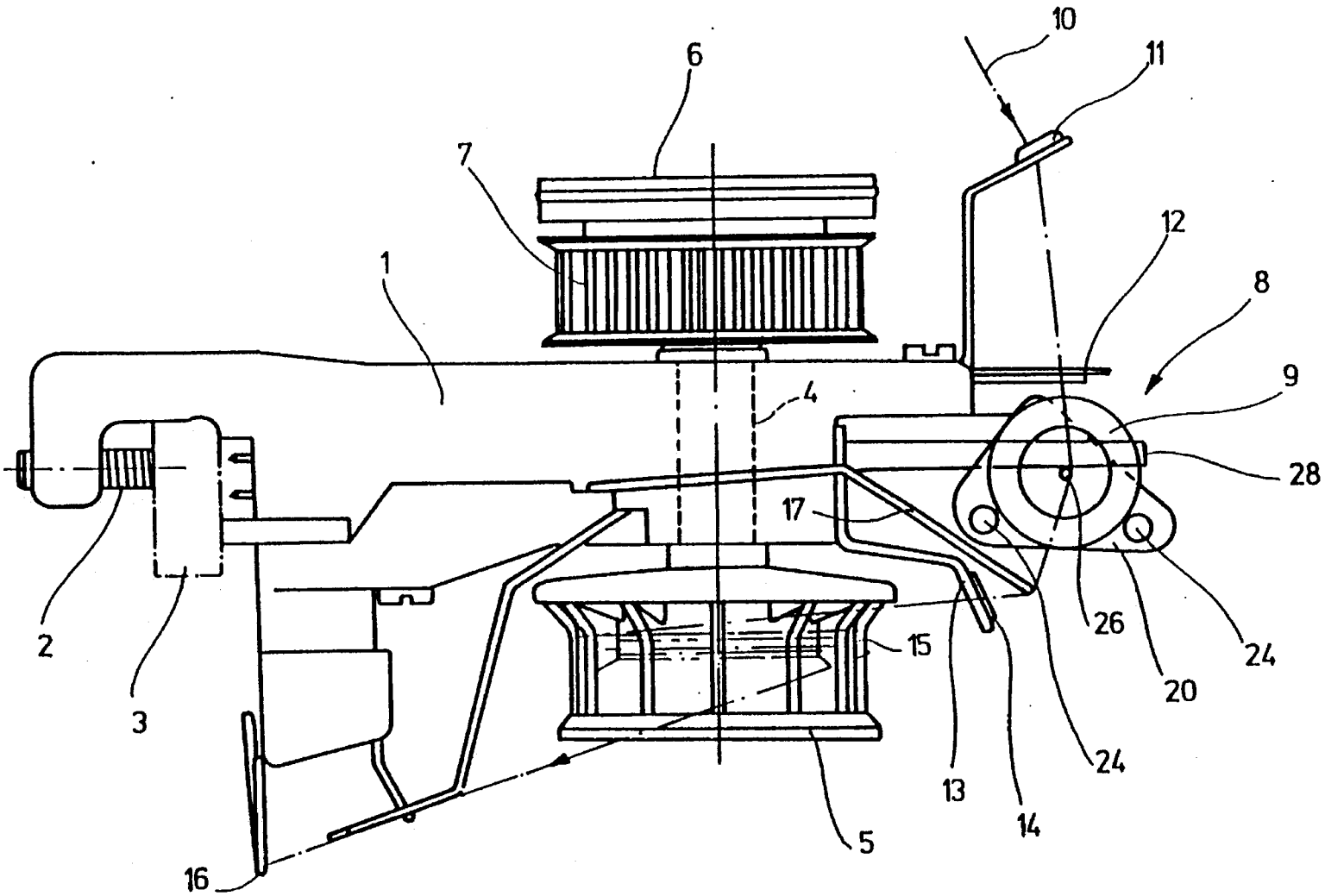
FIG. 1 is a side view of a yarn feeder with a yarn brake according to the invention.

The yarn feeder shown in FIG. 1 is known in terms of its basic design. It has a holder 1, which can be secured by means of a clamping screw 2 to a support ring, suggested at 3, for instance in a circular knitting machine, and a continuous shaft 4 is supported rotatably in it. When the holder 1 is mounted in the operational position, this shaft has a vertical alignment. On one end, the shaft 4 is joined in a manner fixed against relative rotation to a yarn drum, in the form of a bar cage, located under the holder 1; on its upper end, it has a toothed belt pulley 7 that can be coupled in a manner fixed against relative rotation via a coupling 6, and by way of this pulley the yarn drum 5 can be made to revolve, by means of an endless toothed belt (not otherwise shown).

On the face end of the holder 1 opposite the clamping screw 2, there is a yarn brake, which has two identical, essentially disklike brake plates 9, between which a yarn 10 travels. The course of yarn travel extends from a bobbin, not shown in detail, through a yarn eyelet 11 secured to the holder 1, a knot catcher 12, and the yarn brake 8 to a yarn inlet eyelet 14, secured to the holder 1 via an angle element 13, and from this latter eyelet the yarn 10 runs onto the yarn drum 5, on which it forms a storage package 15 and from which it travels via a yarn outlet eyelet 16, also provided on the holder 1, to the yarn using station.

Figure 2:
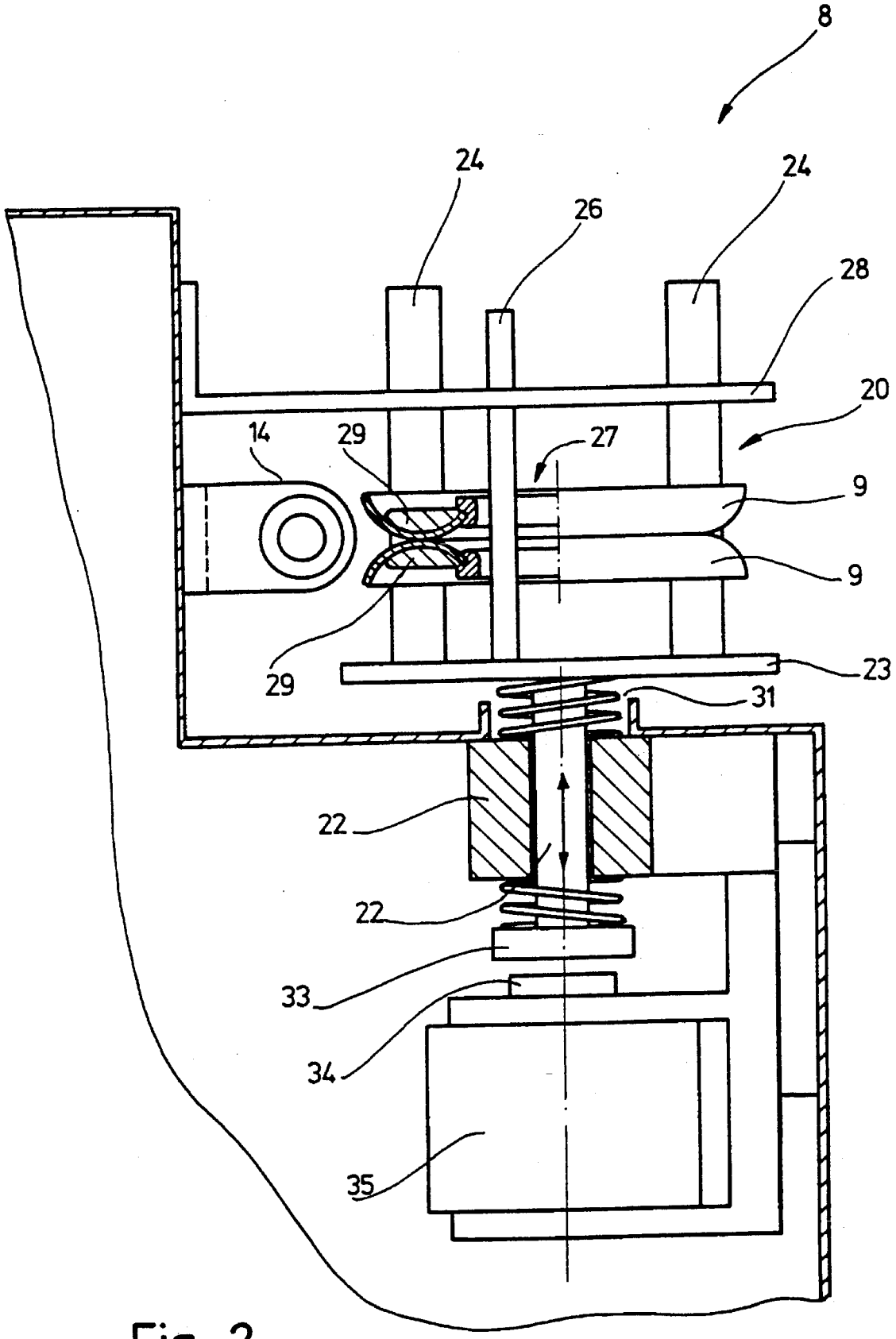
FIG. 2 is a plan view, on a larger scale, of the yarn feeder of FIG. 1, which is cut away in the region of the yarn brake and otherwise is shown in fragmentary fashion.

The yarn brake 8, as seen particularly in FIG. 2, has a bearing means 20, by which the brake plates 9 are retained and supported. The bearing means 20 is in turn rigidly joined to a pin 21, which is supported, in an axially displaceable manner with little play, in a bush 22 that is held stationary on the yarn feeder. The bearing means 20 has a base plate 23, joined directly to the pin 21, and from the base plate, two bearing pins 24 and one yarn deflection pin 26 extend parallel to the pin 21 but in the opposite direction from it. The bearing pins 24 have a considerably smaller diameter than the brake plates 9 and are spaced apart from one another on the base plate 23 by a distance that is less than the diameter of the brake plates 9. The base plate 23 is firmly joined to the bearing pin 24, the pin 21 and the yarn deflection pin 26, so that the overall bearing means 20 is a single cohesive unit.

The brake plates 9 each have a central opening 27, through which the yarn deflection pin 26 extends. The brake plates 9, which are thus annular in form, are curved in approximately a circular arc on their bearing faces pointing toward one another and rest with their outer circumferential faces, each of which is provided with a wear-reducing coating, on the bearing pins 24. On their sides, oriented away from one another, the brake plates 9 have concave, annular indentations, in which like annular permanent magnets 29 are seated. These magnets are concentric with the brake plates and are polarized axially, and the polarization is chosen such that the brake plates 9 attract one another.

The brake plates 9 are retained in captive fashion on the bearing means 20 by means of a bail or bracket 28, which is retained in stationary fashion on the holder 1 parallel to and spaced apart from the base plate 23. There is sufficient space between the bail 28 and the base plate 23 for the brake plates 9 that are retained with axial play.

The bearing means 20, supported axially displaceably in the bush 22 via the pin 21, is supported by its base plate 23 on the bush 22, via a helical spring 31. On the opposite side of the pin 21, another helical spring 32 is provided, which on one end is likewise supported on the bush 22 and on the other is supported on an armature 33 seated on its end on the pin 21.

The armature 33 is formed as a flat, cylindrical, disklike body, and in its position of repose it is spaced apart by some distance from a magnet pole piece 34 of an electromagnet 35. This magnet is retained in stationary fashion relative to the yarn feeder and to the bush 22. The armature 33 is a soft magnetic body that with the magnet pole piece 34 defines an air gap. When the electromagnet 35 is excited, the armature 33 is attracted, regardless of the polarity of the excitation.

Operation:

The yarn brake described thus far, in a yarn feeder that otherwise operates conventionally, functions as follows:

The yarn traveling over the yarn course described is located between the brake plates 9, which are attracted to one another by the permanent magnets 29. As the yarn enters in a first secant direction between the brake plates 9 toward the yarn deflector pin 26, it is deflected by the yarn deflector 26, causing it to emerge from the brake plates 9 in a second secant direction toward the yarn inlet eyelet 14. The yarn, clamped between the brake plates 9, thus has both a radial component of motion and a circumferential component of motion both at the inlet point and at the outlet point.

In operation, the electromagnet 35 is acted upon continuously with a pulsating voltage, for instance an alternating voltage. The armature 33 is thus periodically attracted, causing the entire bearing means 20 to oscillate at an amplitude of about 0.1–0.3 mm approximately in the longitudinal direction of the bearing pins 24. The frequency of this oscillation is dimensioned such that the brake plates 9 do not significantly oscillate with it but instead, because of their mass inertia in the axial direction, remain essentially in repose. This is achieved with a frequency that is between 100 Hz and 1 kHz, typically 500 Hz. Since the brake plates 9 are essentially in repose in this respect, and the bearing means 20 is oscillating in the axial direction, a continuous relative motion is brought about between the bearing means 20 and the brake plates 9, which cancels out the static friction between the outer circumferential faces of the respective brake plate 9 and the bearing pins 24. Thus, because of the circumferentially oriented component of motion of the entering and leaving yarn, the brake plates 9 can execute a rotary motion, with the result that the yarn traveling therethrough cleans the brake plates 9, or in other words frees them of deposits. Because of the oscillation, deposits located on the circumferential face of the respective brake plate 9 are also removed. It has moreover been demonstrated that as a result of the oscillation of the bearing means 20, a certain torque can be created, which reinforces the rotation of the brake plates 9 in the direction of the yarn 10 traveling between them.

The brake plates 9 that brake the yarn are adjusted in their axial position relative to the bearing means 20 by the yarn 10 traveling between them. No means whatever by way of which oscillation might be transmitted from the bearing means 20 to the brake plates 9 are present. Thus the relative motion between the brake plates 9 and the bearing means 20 is practically equivalent to the amplitude of motion of the bearing means 20. A slight oscillational amplitude of a maximum of 1 mm is therefore sufficient for excitation purposes. Hence the electromagnet 35 can be made relatively small in size.

A further improvement to the mode of operation is obtained if the spring-mass system formed by the helical springs 31, 32 and the bearing means 20 has a resonance that is approximately equivalent to the excitation frequency impressed via the electromagnet 35 and the armature 33. This makes the attainable oscillation amplitude maximal at even a slight excitation output.

Figure 3:
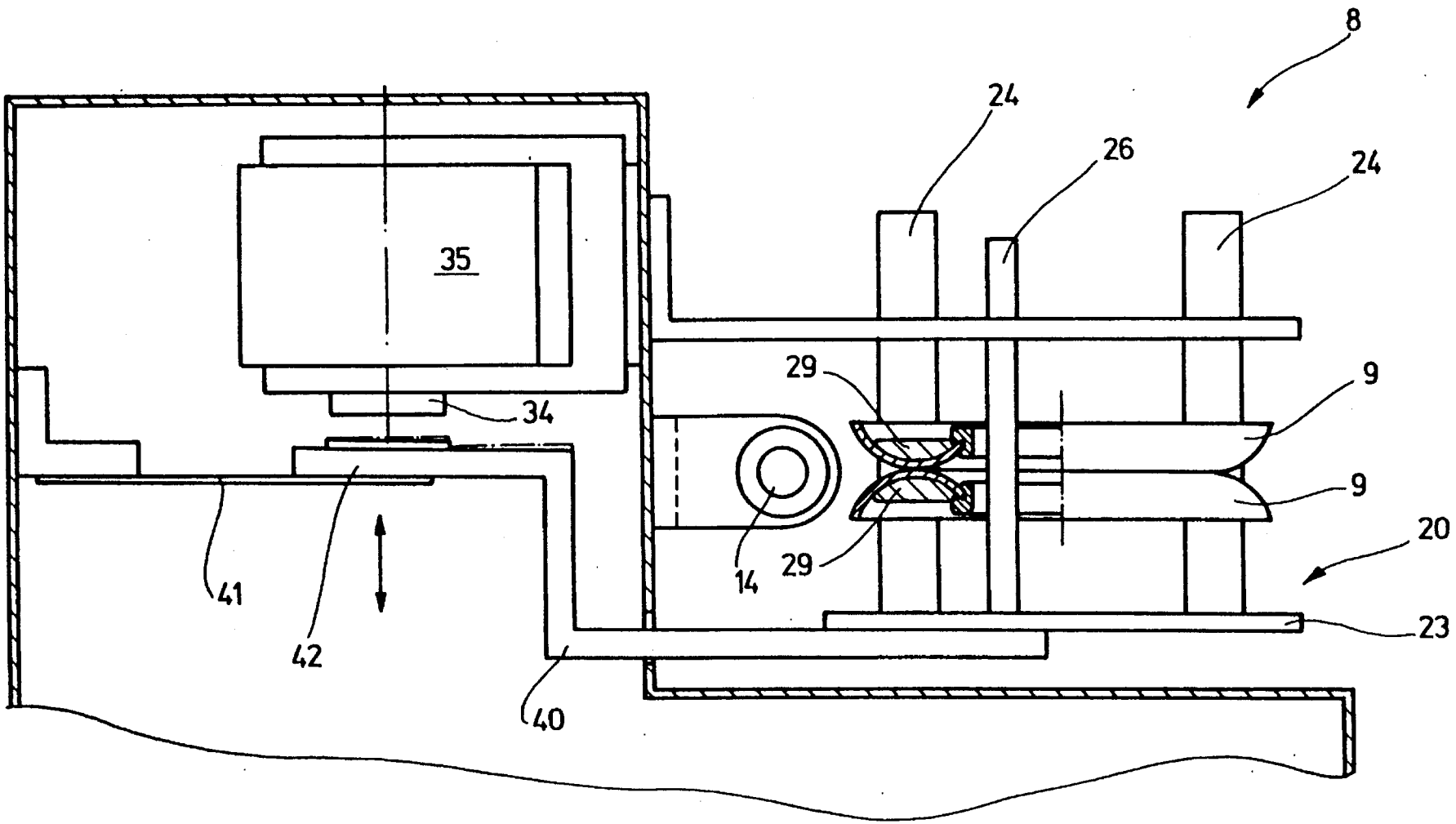
FIG. 3 is a plan view of a different embodiment of the yarn brake.

A somewhat modified way of inducing oscillation in the bearing means 20 is shown in FIG. 3. The bearing means 20, otherwise formed like that described in conjunction with FIG. 2, is retained on an arm 40 that extends away from the base plate 23 at a right angle relative to the bearing pins 24. This arm 40 is in turn resiliently suspended via a leaf spring 41 secured to its other end. The arm 40 is in the form of an elbow bend, so that the leaf spring 41 in the position of repose of the bearing means 20 is located approximately in the plane defined by the yarn traveling through the brake plates 9.

At the junction between the arm 40 and the leaf spring 41, a segment 42 acting as an armature 33 is provided, which is located at a certain distance from the electromagnet 35 already described in conjunction with FIG. 2. Between the magnet pole piece 34 of the electromagnet 35 and the segment 42, an air gap is formed that increases or decreases in size as the arm 40 swivels.

In this embodiment of the yarn brake 8 as well, an oscillatory motion of the bearing means 20 is brought about during operation by the electromagnet 35. However, the bearing means does not execute any purely axial oscillation, but instead, upon oscillating, swivels on the arm 40 about a swivel axis defined by the leaf spring 41. This motion has both an axial and a radial component. Besides the effects already described, caused by the axial oscillation, a further aspect of this embodiment is that because of the radial component of the oscillation, a stronger moment that drives the brake plates 9 can be created.

Figure 4A:
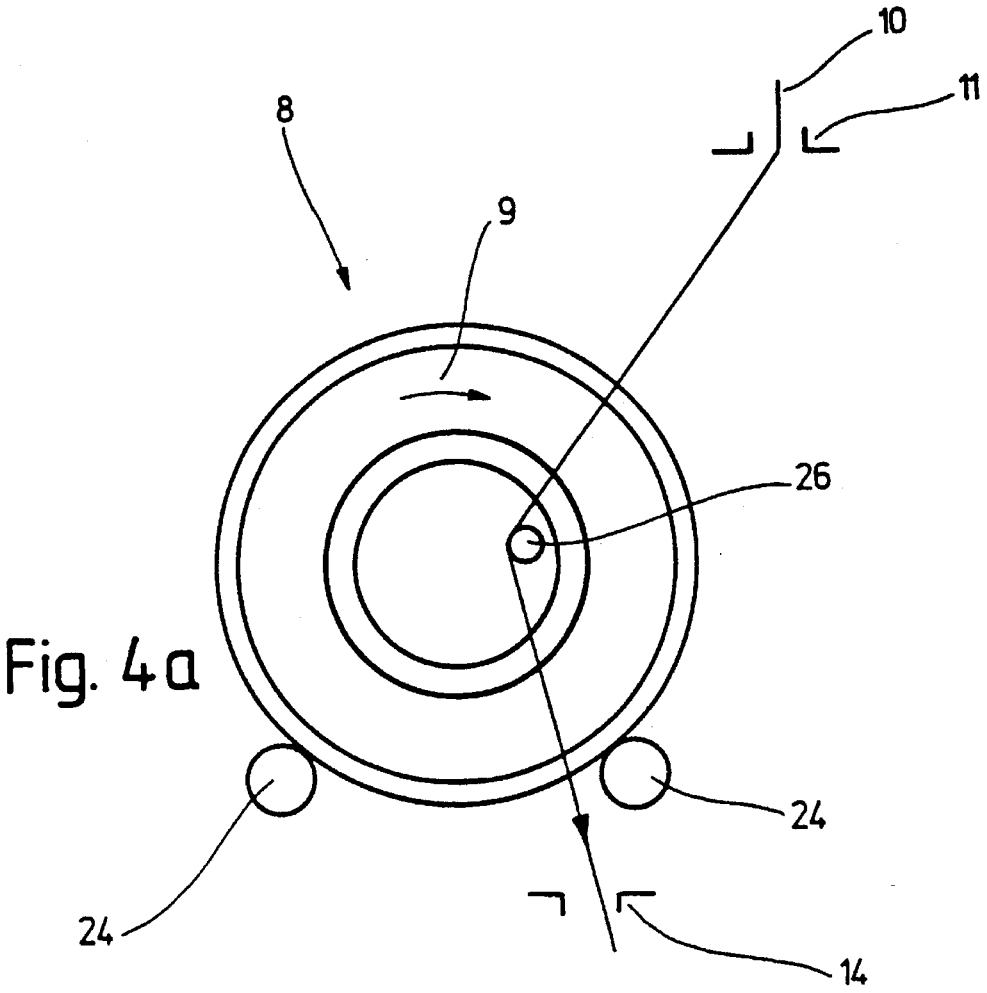
FIGS. 4A and 4B are a fragmentary side view and plan view, respectively in section, of another embodiment of the yarn brake.
Figure 4B:
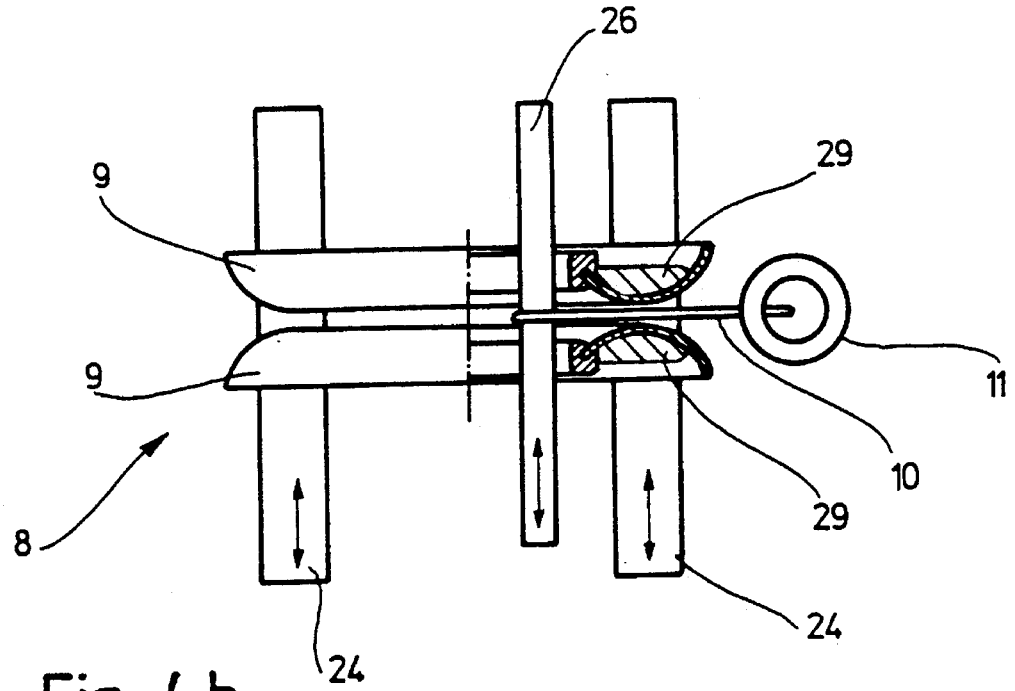
Figure 5A:
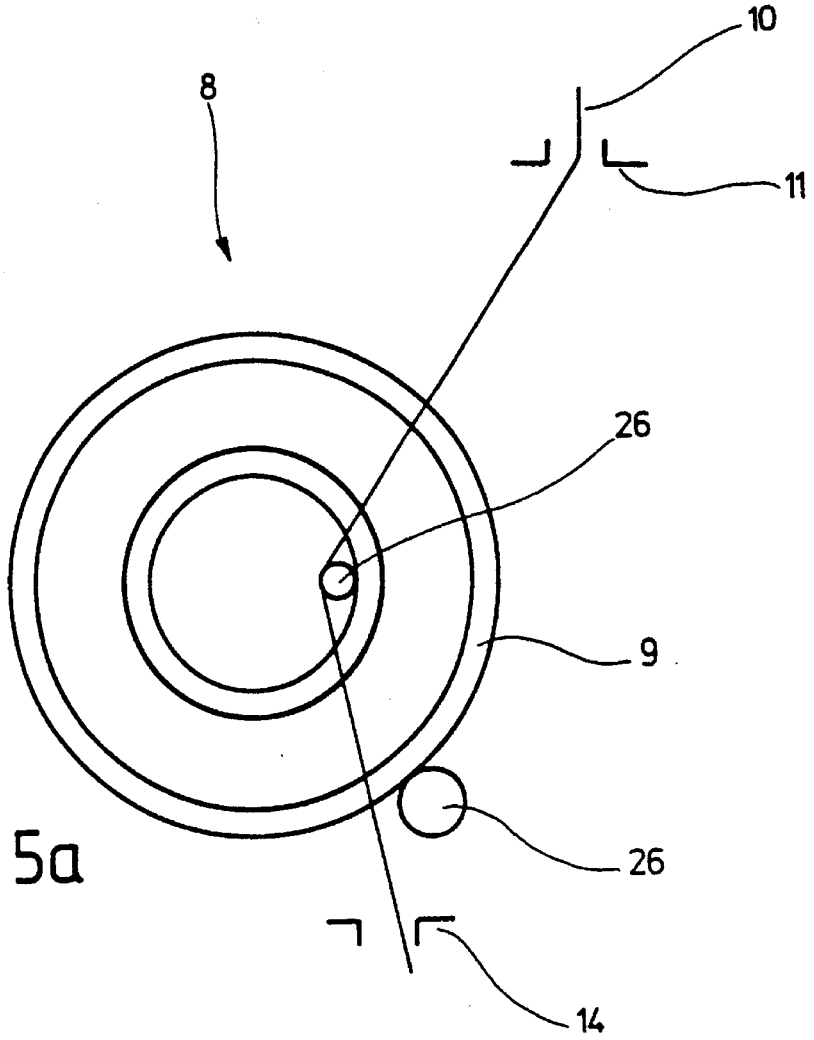
FIGS. 5A and 5B are a fragmentary side view and plan view, respectively in section, of another embodiment of the yarn brake.
Figure 5B:
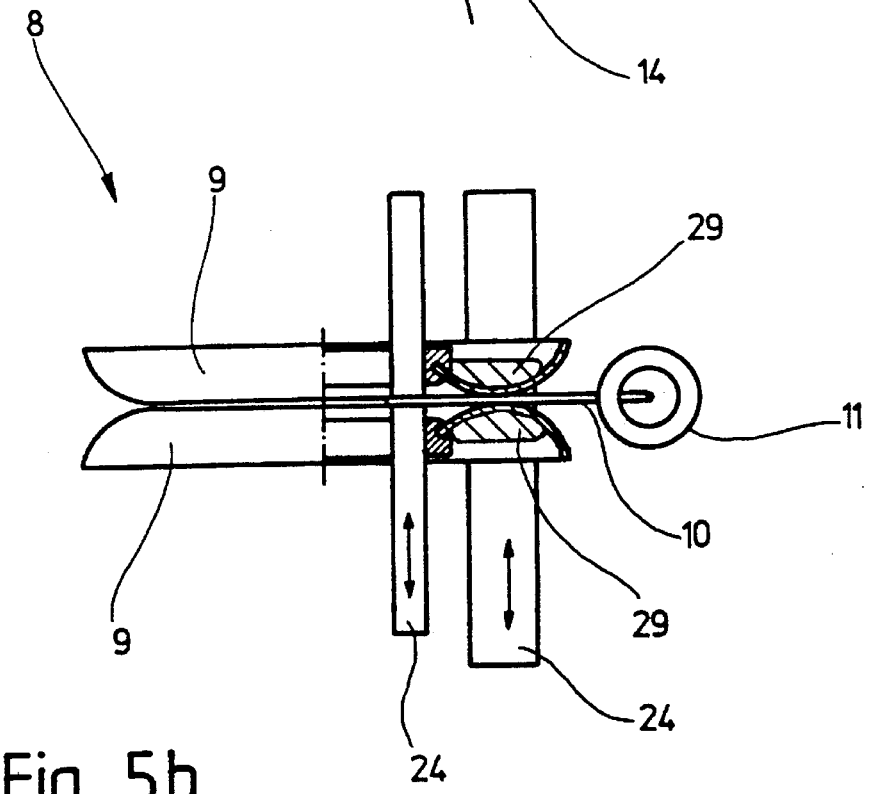

FIGS. 4*a*, 4*b* and 5*a*, 5*b* show an embodiment of the yarn brake 8 that is modified in terms of the location of the bearing pins 24 and yarn deflection pin 26; regardless of this, it can be set into axial oscillation in both of the ways already shown. In the yarn brake 8 shown in FIGS. 5*a* and 5*b*, only a single bearing pin 24 is provided, which rests on the respective outer circumferential face of the brake plates 9, whereas FIGS. 4a and 4*b* show two bearing pins 24. A second support point for the brake plates 9 is formed by the yarn deflection pin 26, which here is in contact with the edge of the opening 27 of the respective brake plate 9.

The advantage of these embodiments, whose mode of operation otherwise matches that of the embodiment already described, is that the yarn deflection pin 26 and the openings 27 provided with wearproof coatings can also be kept effectively clean. Because of the oscillation caused by the electromagnet and the rotary motion of the brake plates 9, paraffin, oil and fluff deposits are averted or removed.

Figure 6A:
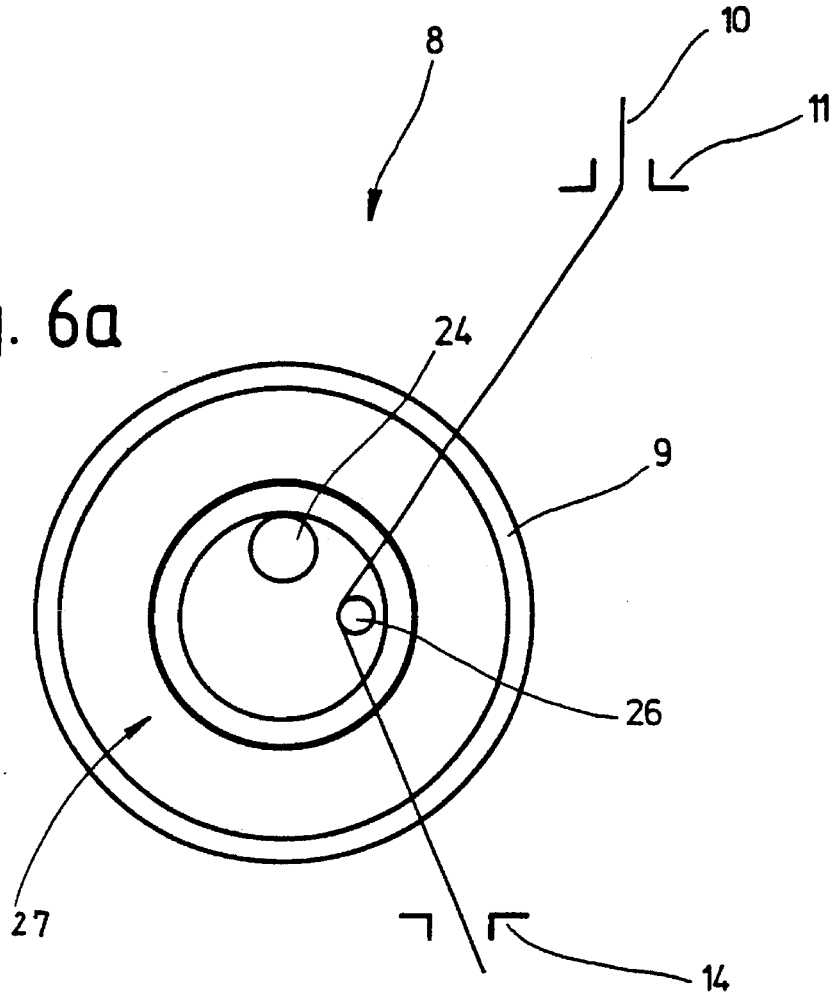
FIGS. 6A and 6B are a fragmentary side view and plan view, respectively in section, of another embodiment of the yarn brake.
Figure 6B:
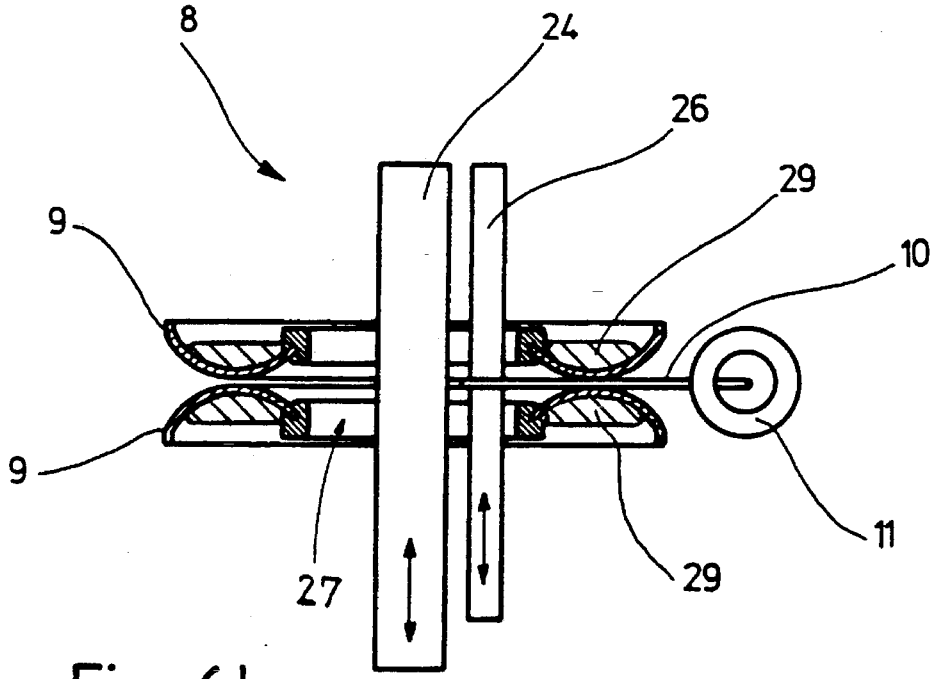

In a further embodiment, shown in FIGS. 6*a* and 6*b*, both the bearing pin 24 and the yarn deflection pin 26 are located inside the openings 27 of the brake plates 9. However, only the bearing pin 24 is in contact with the inner wall of the opening 27. Otherwise, the brake plates 9 are largely freely suspended, and they are adjusted in their precise position by the yarn 10. Once again, the brake plates 9 are provided with a wear-reducing coating in the region of the opening 27.

Figure 7:
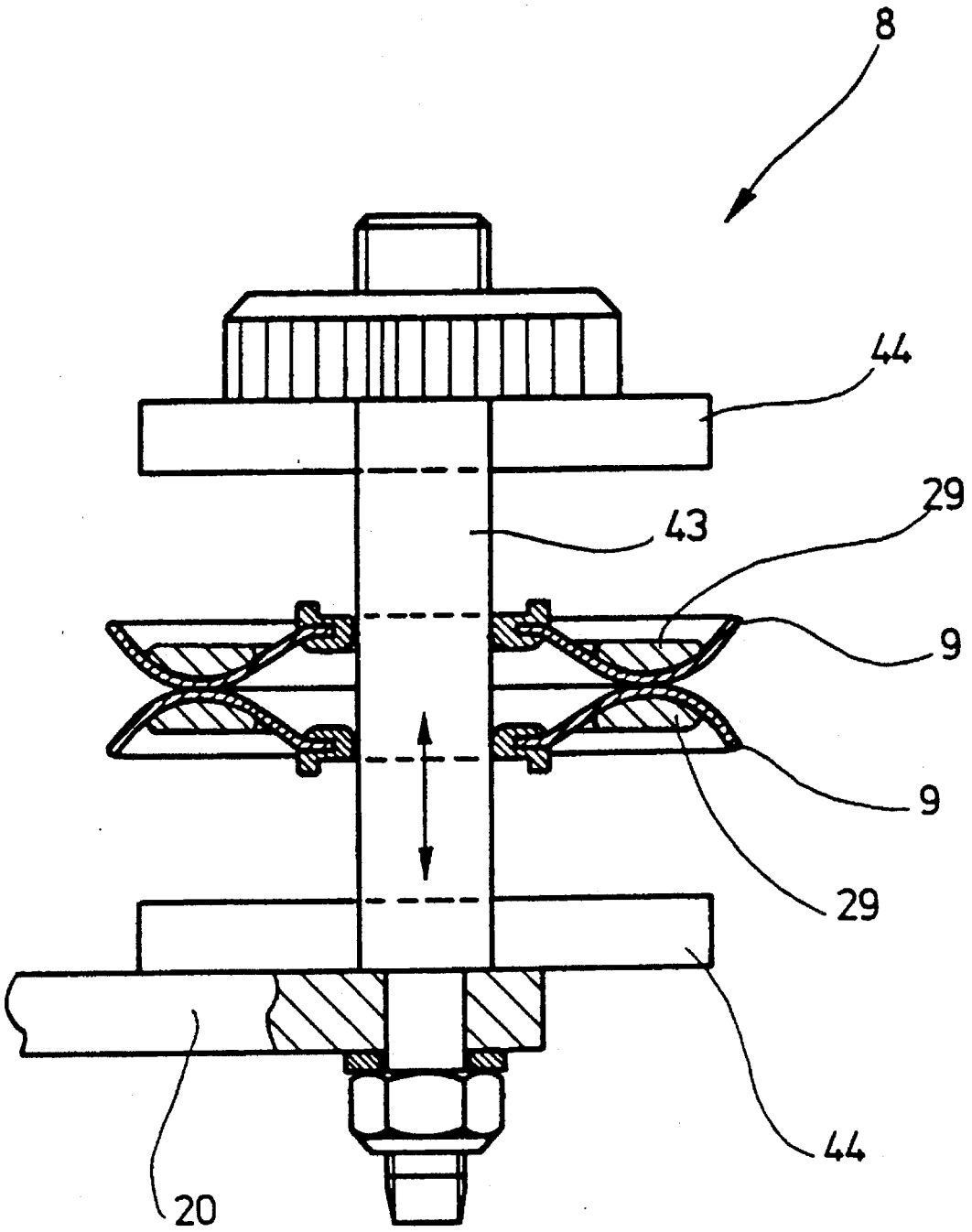
FIG. 7 is a fragmentary, partially cutaway plan view of a yarn brake with a central guide pin and magnetic centering of the yarn brake elements.

In a further embodiment of the yarn brake 8, shown in fragmentary form in FIG. 7, the brake plates 9 are supported both rotatably and axially displaceably on a guide pin 43 that is part of the oscillating bearing means 20. The guide pin 43 and the openings 27 are dimensioned in terms of their respective diameter such that the brake plates 9 are seated on the guide pin 43 without excessive play. The guide pin 43 in this embodiment of the yarn brake 8 takes on both the bearing function for the brake plates 9 and the function of the yarn deflection pin 26.

Figure 8:
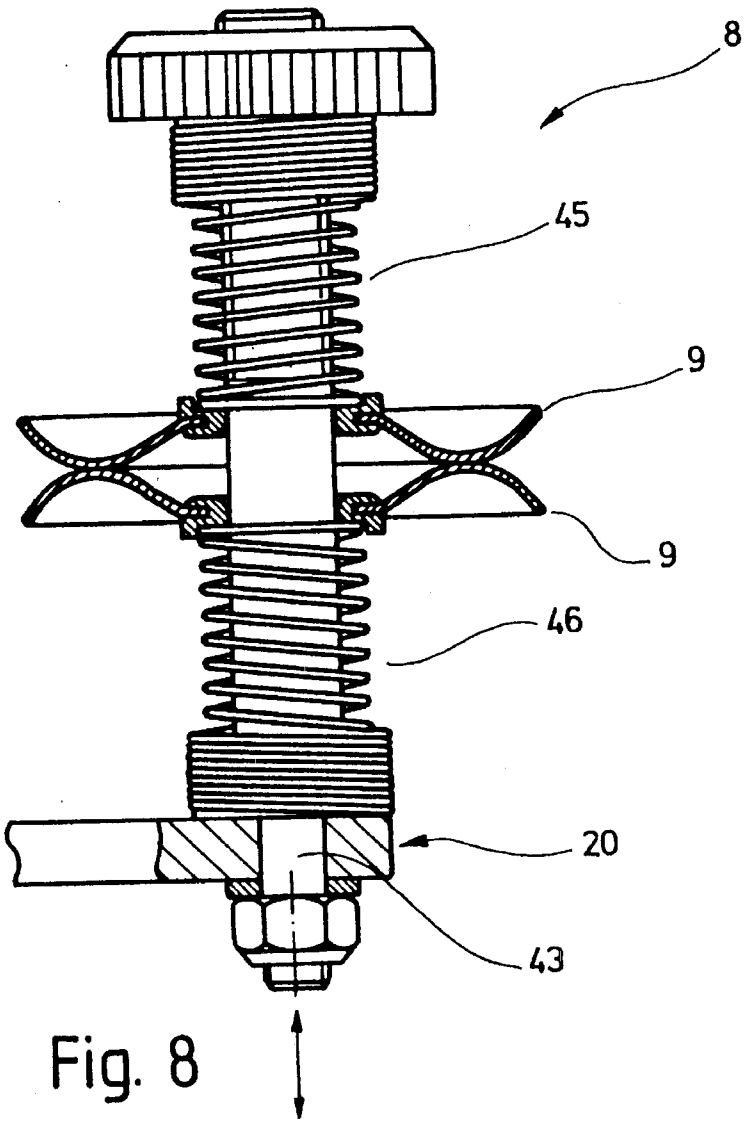
FIG. 8 is a fragmentary, partially cutaway plan view of a yarn brake with a central guide pin and with spring elements for central support of the brake elements.

To reinforce the centering of the brake plates 9 on the guide pin 43, the guide pin is provided with magnets 44 on both ends; these magnets are in the form of a bar, disk or ring and are axially polarized. The magnet 44 located on the free end of the guide bolt 43 is provided with a knurled nut, which is seated on a thread provided on the end of the guide pin 43. The magnets 44 are polarized such that they repel whichever brake plate 9 is located before them in the axial direction. The force of repulsion addtionally presses the brake plates 9 together. In addition, the brake plates 9 thereby assume an approximately central position between the magnets 44. The force that presses them together can be varied by varying the distance to which the knurled nut is screwed onto the guide pin 43. Otherwise, this yarn brake 8 likewise functions essentially like the yarn brakes described above. Once again, as a result of an axial oscillation of the bearing means 20, or in this case the guide pin 43, a relative motion is brought about between the brake plates 9, which are essentially in repose but are rotating slowly, and the guide pin 43, and as a result, static friction is overcome and deposits are avoided. The oscillation of the brake plates itself can be kept slight if the natural frequency, which is determined by the resilience of the magnetic fields operative between the permanent magnets 29 and the magnets 44 and the mass of the brake disks 9, is less than the excitation frequency. An embodiment of the yarn brake 8 in which the permanent magnets 29 and the magnets 44 are replaced with helical springs 45, 46 is shown in FIG. 8. The helical spring 45 is supported on one end on the knurled nut and on the other on a brake plate 9. The helical spring 46, which is fastened between the other brake plate 9 and the bearing means 20, rests on the opposite side. Both helical springs 45, 46 are seated concentric with the guide pin 43, presses the brake plates 9 together and at the same time centering them. If the helical springs 45, 46 are designed to be relatively nonrigid, so that the oscillatable spring-mass system formed by the helical springs 45, 46 and the brake plates 9 has a resonant frequency that is markedly below the excitation frequency at which the bearing means 20 oscillates, then in this embodiment as well, the brake plates 9 remain essentially in repose, merely rotating slowly. The advantages described above, brought about by the axial oscillation of the bearing means 20, are therefore attained in this embodiment as well.

An especially uniform yarn tension in the ongoing part of the yarn can be attained if the dimensions are such that the brake elements 9 are essentially in repose relative to one another. Thus the braking force exerted on the yarn 10 is not subjected to any fluctuations over time.

The brake element 9 may be in disk or plate form, and in particular it may also be continuous, or in other words without any central opening. The yarn 10 is then clamped between the faces with which the brake elements 9 rest on one another and is braked as it passes through. However, it is advantageous if the brake element 9 has a central opening 27 that is surrounded by an annular face with which the brake element 9 rests on the respectively other brake element 9. The yarn is then clamped between the annular faces, which rotate at an essentially uniform circumferential speed. In particular, however, the central openings 27 create space for an elongated guide element 24, 26 or 43 that extends through them, and about which the yarn 10 can be guided. Yarn travel is thus largely determined locally, and defined conditions for the braking action exerted upon the yarn 10 are also created at the yarn brake 8 as a result.

In one embodiment, the brake elements 9 may be retained on at least one support pin 24, forming an elongated guide element provided on the bearing means 20. This support pin—guide element 24 penetrates the brake elements 9 in their central opening, thereby performing a dual task. First, the guide element 24 supports the brake elements 9, and second, it can be used for yarn guidance. In this embodiment, the effective static friction between the brake elements 9 and the guide element 24 that is to be overcome is relatively slight from the very outset, so that even a slight oscillation will already suffice to overcome it.

In another embodiment, the guide element 26 may have a diameter that is substantially less than the diameter of the central opening 27, and the guide element 26 is located so as to penetrate the central opening 27 eccentrically. The guide element 26 in this case serves merely to guide the yarn. Because of the considerable radial play that is established, further devices are required for providing the actual rotatable support or retention of the brake element 9. These devices may for instance be two spaced-apart, parallel bearing pins 24, with which the brake elements 9 are in contact by way of their respective outer circumferential faces. The bearing pins 24 support the contacting brake elements 9 on their outer circumferential faces, and the brake elements 9 rest relatively loosely on the bearing pins 24. They can both execute a tilting motion and be lifted up from the bearing pins 24. Moreover, they can slide along the bearing pins 24, so that axial play is also present. In operation, the brake elements 9 revolve and slide with their outer circumferential faces on the bearing pins 24. To overcome static friction that might otherwise possibles-occur at those points, the bearing means 20 oscillates in the axial direction, or in other words longitudinally, and thus the two bearing pins 24 likewise oscillate in the same way.

It is advantageous if the brake elements 9 are provided with a wear-reducing coating on their outer circumferential faces, thereby preventing wear of these outer circumferential faces of the brake elements 9.

Because of their axial play, the brake elements 9 are guided and positioned in the axial on the bearing means 20 solely by the yarn 10 that is to be braked.

In principle, both spring elements and permanent magnets, provided on the brake elements 9, are possible as loading means. If a permanent magnet that is axially polarized in such a direction that the brake elements 9 attract one another when they are oriented toward one another with their bearing faces, is provided on each brake element 9, then the brake elements 9 are prestressed resiliently toward one another, without being in any way coupled, in terms of force transfer, with the bearing means 20. In this embodiment, the brake elements 9 are very well decoupled in terms of oscillation from the bearing means 20, so that they can remain essentially in repose while the bearing means 20 oscillates.

If needed, centering of the brake elements 9 may be reinforced by magnets 44 provided on the bearing means 20 on both sides of the brake elements 9 contacting one another. This is especially simple if the brake elements already contain magnets 44 in order to be urged toward one another. If at least one of these magnets 44 is axially adjustable in the direction of the axis of symmetry of the brake elements 9, then the thus-centered brake disks can be adjusted in terms of their braking force. In another embodiment, the brake elements 9 may also be centered by spring means 45, 46 on the bearing means 20. The spring means 45, 46, in the simplest case helical springs, are relatively inexpensive, and if they have an appropriate length and relative nonrigidity they also bring about good decoupling, in terms of oscillation, of the brake elements 9 from the bearing means 20.

To generate oscillation, a number of oscillatory motion generating means are in principle possible. However, it is advantageous to use an electromagnet 35 with a soft magnet or permanent magnet armature 33. In the case of a permanent magnet armature 33, the oscillation frequency is equivalent to the excitation frequency of the electromagnet 35. A soft magnet armature 33 oscillates at twice the frequency and at possibly a somewhat lesser amplitude.

The armature 33 and thus the bearing means 20 joined to it can be resiliently suspended. The resilient suspension assures a position of repose and averts impact of the armature 33 against the electromagnet 35. Moreover, by suitable dimensioning of the spring, it is possible to shift the mechanical resonant frequency of the oscillatable system, formed by the resilience of the spring and the mass of the bearing means 20, to the vicinity of the excitation frequency. As a result, the oscillation has a high amplitude, and even slight excitation energies thus suffice. The electromagnet can therefore be correspondingly small in size.

If the bearing means 20 is suspended from a leaf spring via a lever, in such a way that it can execute a swiveling motion, then the oscillation of the bearing means 20 is given both a relatively major axial component and a radial component, although the radial component is correspondingly less. In that case, both components of the motion of the bearing means 20 contribute to the effect of cleaning and driving of the yarn brake.

Various changes and modifications may be made, and features described in connection with any one of the embodiments may be used with any of the others, within the scope of the inventive concept.

We claim:

1. A yarn brake (8) comprising:

a first rotatably supported brake element (9) and a second rotatably supported brake element (9), said second brake element having a face that is in contact with a yarn (10) to be braked, said face being formed rotationally symmetrically;

a support bearing means (20) removably coupling said first and second brake elements (9) coaxial relative to one another, said support bearing means supporting said first and second brake elements rotatably and freely axially displaceably about their common axis of symmetry;

a biassing means (29) resiliently pressing the brake elements (9) against one another; and an oscillatory motion generating means (33, 35) coupled to said support bearing means (20) for oscillating said support bearing means (20) in a direction which is oriented substantially in an axis of symmetry of the first and second brake elements (9) retained on the support bearing means (20).

2. The yarn brake as defined by claim 1, wherein said first and second brake elements (9) are decoupled, with respect to force transfer, from the support bearing means (20) in the axial direction.

3. The yarn brake as defined by claim 1, wherein the mass inertia of the first and second brake elements (9) and the frequency of oscillation of the support bearing means (20) are dimensioned with reference to one another such that the first and second brake elements (9) essentially do not oscillate, or oscillate at a substantially smaller amplitude than the support bearing means (20).

4. The yarn brake as defined by claim 1 wherein the first and second brake elements (9) are substantially in repose relative to one another.

5. The yarn brake as defined by claim 1, wherein the first and second brake elements (9) are substantially in disk or plate form.

6. The yarn brake as defined by claim 1, wherein the support bearing means (20) includes at least one elongated guide element (24, 43) for retaining at least one of said first and second brake elements (9).

7. The yarn brake as defined by claim 1, wherein at least one of the first and second brake elements (9) has a central opening (27) that is substantially surrounded by an annular face with which one of the first and second brake elements (9) respectively rests on the other brake element (9).

8. The yarn brake as defined by claim 7, wherein the support bearing means (20) includes at least one elongated guide element (24, 43) for retaining said first and second brake elements (9);

and wherein the elongated guide element (24, 43) substantially penetrates the central opening (27).

9. The yarn brake as defined by claim 8, wherein the elongated guide element (24) has a diameter that is substantially less than the diameter of the central opening (27), and wherein the elongated guide element (26) is oriented so as to penetrate the central opening (27) eccentrically.

10. The yarn brake as defined by claim 8, wherein the guide element (43) penetrates the central opening (27) of at least one of the first and second brake elements (9) substantially centrally, and wherein the guide element (43) is dimensioned such that at least one of the first and second brake elements (9) is supported on the guide element (43).

11. The yarn brake as defined by claim 1, wherein the support bearing means (20) has at least two spaced-apart, parallel bearing pins (24), with which the first and second brake elements (9) are in contact with their respective outer circumferential face.

12. The yarn brake as defined by claim 11, wherein at least one of the first and second brake elements (9) is provided with a wear-reducing coating on its respective outer circumferential face.

13. The yarn brake as defined by claim 1, wherein at least one of the first and second brake elements (9) is guided and positioned, with respect to its axial position on the support bearing means (20), solely by the yarn (10) to be braked.

14. The yarn brake as defined by claim 1, wherein the biassing means (29) includes cooperating permanent magnets (29) provided on at least one of the first and second brake elements (9).

15. The yarn brake as defined by claim 14, wherein the permanent magnets (29) are substantially axially polarized.

16. The yarn brake as defined by claim 14, wherein, to vary the brake forces provided by the first and second brake elements (9), magnets (44) are provided on the support bearing means (20), on diametrically opposite sides of the first and second brake elements (9) so as to urge the first and second brake elements into contact.

17. The yarn brake as defined by claim 16, wherein the magnets (44) are substantially axially polarized.

18. The yarn brake as defined by claim 17, wherein at least one of the magnets (44) is substantially axially adjustable in the direction of the axis of symmetry of the first and second brake elements (9).

19. The yarn brake as defined by claim 1, wherein the biassing means includes spring means; and wherein the first and second brake elements (9) are urged toward one another by the spring means (45, 46).

20. The yarn brake as defined by claim 1, wherein the oscillatory motion generating means (33, 35) includes an electromagnet (35) having one of a soft-magnet and a permanent-magnet armature (33).

21. The yarn brake as defined by claim 20, wherein the armature (33) is substantially resiliently supported via spring means (31, 32, 41) and carries the support bearing means (20).

22. The yarn brake as defined by claim 21, wherein the armature (33) is coupled to the bearing means (20) via a pin (21) slidingly guided in a bush (22), and is supported via spring means (31, 32).

23. The yarn brake as defined by claim 21, wherein the armature (33) is substantially supported at one end on a leaf spring (41) and at the other carries the bearing means (20), which oscillates with swiveling motions, so that the oscillation has both a predominant axial component and a markedly less pronounced radial component.

* * * * *